United States Patent [19]

Cordery et al.

[11] Patent Number: 4,999,641

[45] Date of Patent: Mar. 12, 1991

[54] MAGNETIC ANTENNA SYSTEM HAVING INDEPENDENTLY CONTROLLABLE ELECTRICAL FIELD SHIELDING AND MAGNETIC FIELD BALANCE

[75] Inventors: Robert A. Cordery, Danbury, Conn.; Michael F. Hartings, West Carrollton, Ohio

[73] Assignee: Monarch Marking Systems, Inc., Dayton, Ohio

[21] Appl. No.: 401,962

[22] Filed: Sep. 1, 1989

[51] Int. Cl.[5] ..... H01Q 7/04

[52] U.S. Cl. ..... 343/742; 343/842; 343/867

[58] Field of Search ..... 343/742–744, 343/866–868, 842, 870; 340/572, 551, 552, 561

[56] References Cited

U.S. PATENT DOCUMENTS 4,751,516 6/1988 Lightblau ..... 343/742

*Primary Examiner*—Michael C. Wimer

*Attorney, Agent, or Firm*—Mason, Kolehmainen, Rathburn & Wyss

[57] ABSTRACT

A magnetic antenna system particularly useable in electronic article surveillance systems for detecting the presence of a resonant tag utilizes multiple loop shielded transmitting and receiving antennas. The antennas employ shield structures that are designed to minimize the electric field response and to provide a balanced magnetic field response. The magnetic field responses of different ones of the loops in each of the antennas are different and the loops are oriented so that more responsive loops of the transmitting antenna are positioned opposite less responsive loops of the receiving antenna and vice versa in order to reduce the coupling between antennas without reducing the sensitivity of the receiving antenna to a tag signal.

22 Claims, 1 Drawing Sheet

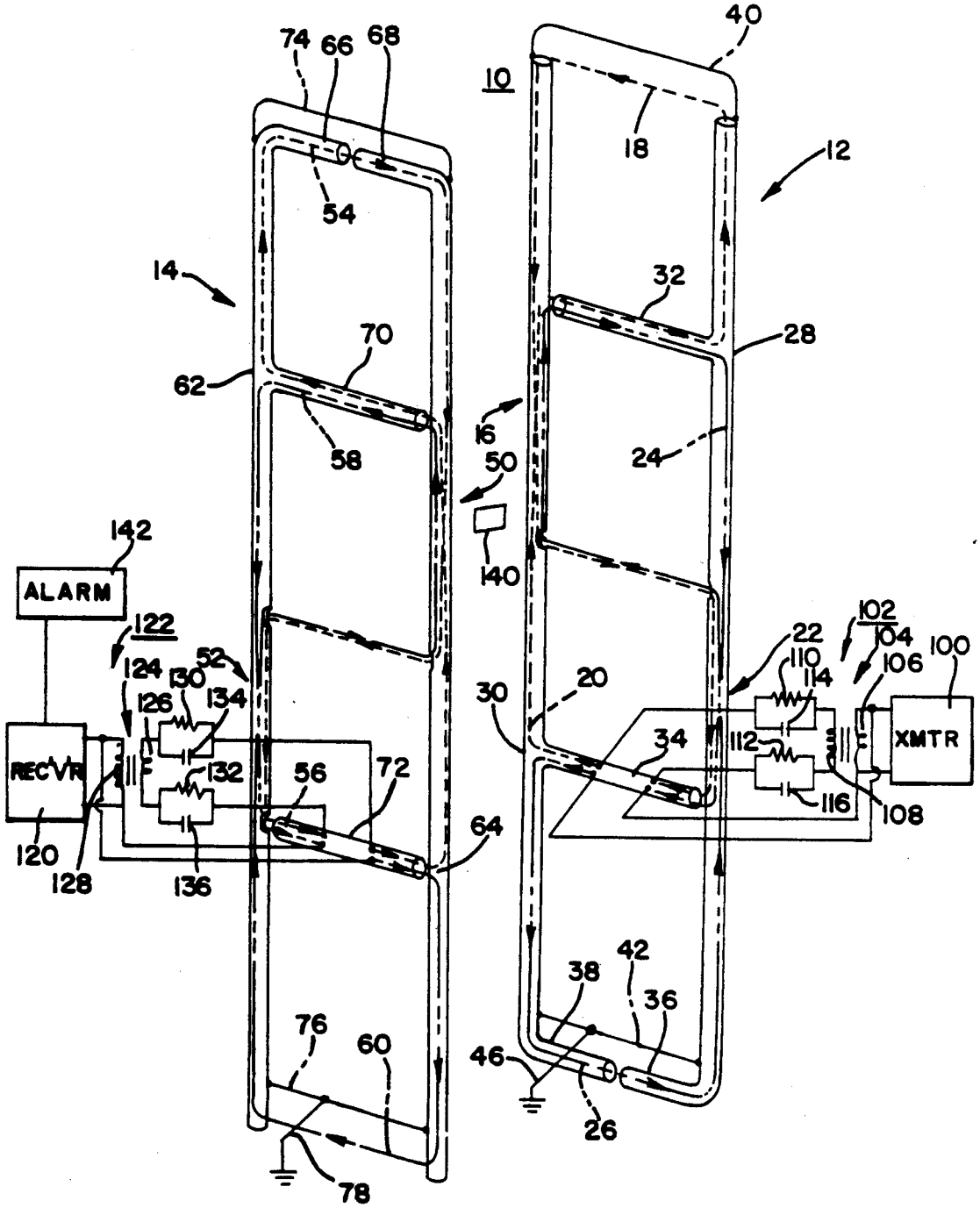
ALARM
REC'VR
XMTR

MAGNETIC ANTENNA SYSTEM HAVING INDEPENDENTLY CONTROLLABLE ELECTRICAL FIELD SHIELDING AND MAGNETIC FIELD BALANCE

BACKGROUND OF THE INVENTION

1. Field of the Invention

This invention relates generally to antennas, and more particularly to antennas that are adapted for use with electronic article surveillance systems or other similar utilization devices. In such systems, the articles being protected are tagged with a tag containing a resonant circuit or other electronically detectable device. Typically, a swept frequency interrogation transmitter whose frequency is swept through the resonant frequency of the tag includes a transmitting antenna located near an exit from a protected area. A receiving antenna is disposed near the transmitting antenna and forms a passageway with the transmitting antenna through which someone exiting the protected area must pass. The receiving antenna is coupled to a receiver that detects the signal radiated by the tag whenever the transmitter frequency passes through the resonant frequency of the tag.

2. Description of the Prior Art

Various antennas usable for electronic article surveillance purposes are known. One such antenna is disclosed in U.S. patent application Ser. No. 07/092,052, filed on Aug. 31, 1987 by John R. Feltz et al., now U.S. Pat. No. 4,872,018. Other such antennas are disclosed in U.S. Pat. Nos. 4,251,808 and 4,751,516 to Lichtblau. The above-described application and patents disclose twisted loop antennas designed for electronic article surveillance purposes. The antenna disclosed in the Feltz et al. patent application is fabricated from two twisted loops of coaxial cable that are interleaved to form a multiple loop antenna, while the antennas disclosed in the Lichtblau patents are fabricated in the form of a multiple twisted loop configuration contained within a metal tube. The metal tube of Lichtblau and the shield of the coaxial cable of Feltz et al. , now U.S. Pat. No. 4,872,018, act as electric field shields.

While the antennas disclosed in the Feltz et al. application and in the Lichtblau patents do provide a way to detect a tag passing through an exit from a protected area, both systems have difficulty in detecting a tag when it is passed by the antennas in certain orientations, and both systems have been found to be responsive to certain spurious signals generated by extraneous signals other than tags.

SUMMARY

Therefore, it is an object of the present invention to provide an improved antenna system particularly suitable for use in an electronic article surveillance system.

It is another object of the present invention to provide an antenna for use in an electronic article surveillance system that overcomes many of the disadvantages of the prior art antenna systems.

It is another object of the present invention to provide a high performance antenna system particularly suitable for electronic article surveillance systems.

It is another object of the present invention to provide an improved magnetic antenna system having a well balanced magnetic response to render the antenna responsive to nearby sources of magnetic radiation and generally insensitive to distance sources.

It is another object of the present invention to provide a magnetic antenna that is well shielded against electric fields.

It is yet another object of the present invention to provide an antenna system whose magnetic and electric field responses are independently controllable.

Briefly, the antenna according to the present invention utilizes two twisted loops containing two spaced loop sections that lie in a common plane to generate magnetic fields in phase opposition to each other. The two twisted loops are positioned in a common plane with the loop sections of the two twisted loops being interleaved with each other. Preferably, the two twisted loops are connected in phase quadrature so that adjacent loop sections of the two loops generate a rotating magnetic field. A shield structure surrounds the twisted loops forming the antenna to provide a Faraday shield about the antenna to prevent the antenna from radiating or responding to electric fields. The shield structure is formed from conductive tubes surrounding predetermined portions of the loop sections to provide electric field shielding, and gaps are provided in predetermined sections of the tubes to control the magnetic field coupling between the loops and the shielding tubes. Conductive jumper wires are connected bridging certain ones of the gaps to provide electrical continuity for the electrostatic shield and to provide a balancing loop for the magnetic field to thereby provide independent control of the electric field shielding and the magnetic field balancing of the antenna.

The two twisted loops forming each of the antennas are coupled to their respective transmitter or receiver so that one of the twisted loops is hotter or more responsive than the other. The twisted loops of the two antennas are positioned such that the hotter or more responsive twisted loop of one of the antennas is positioned opposite the cooler or less responsive loop of the opposite antenna. This serves to reduce the coupling between the transmitting and receiving antennas to thereby reduce the amount of transmitter noise received by the receiving antenna without reducing its sensitivity to tag signals, thereby improving the signal to noise ratio of the received signal to improve the detectability of tags.

BRIEF DESCRIPTION OF THE DRAWING

These and other objects and advantages of the present invention will become readily apparent upon consideration of the following detailed description and attached drawing, wherein:

The single FIGURE is a drawing of the antenna system of the invention shown in conjunction with an electronic article surveillance system.

DETAILED DESCRIPTION OF THE PREFERRED EMBODIMENT

Referring now to the drawing, there is shown an antenna system according to the invention, generally designated by the reference numeral 10. The system 10 includes a transmitting antenna 12 and a receiving antenna 14. Each of the antennas 12 and 14 has two interleaved twisted loops that are configured in a configuration similar to the configuration shown in the aforementioned Feltz et al., U.S. Pat. No. 4,872,018 except that in the present invention, the shielding is provided by a separate shielding structure instead of by the shield of a coaxial cable as is done in the Feltz et al. application. The transmitting antenna 12 has an upper twisted loop 16 comprising an upper loop section 18 and a lower loop section 20 interleaved with a lower twisted loop 22 having an upper loop section 24 and a lower loop section 26. A shield structure in the form of a conductive tubular structure fabricated from metal pipes or tubes surrounds the twisted loops. The shield structure includes vertical sections 28 and 30 and horizontal sections 32, 34, 36 and 38. A pair of connecting wires 40 and 42 electrically connect the vertical portions 28 and 30 of the shield structure, and the entire shield structure is grounded by a wire 46 connected to the wire 42. The receiving antenna 14 is similar to the transmitting antenna 12, but it is not exactly the same for reasons which will be discussed below. The receiving antenna has an upper twisted loop 50 and a lower twisted loop 52 that are similar to the upper and lower twisted loops 16 and 22, respectively, of the transmitting antenna 12. The upper twisted loop 50 has an upper loop section 54 and a lower loop section 56, while the lower twisted loop 52 has an upper loop section 58 and a lower loop section 60. The twisted loops 50 and 52 are shielded in a manner similar to the way the loops of the transmitting antenna are shielded by a conductive tubular structure in the form of pipes, tubes or a conductive mesh surrounding predetermined portions of the twisted loops. The receiving antenna 14 includes a pair of vertical pipes 62 and 64 and horizontal shielding pipes 66, 68, 70 and 72. As in the case of the transmitting antenna, the vertical portions of the shield structure are electrically connected together by a pair of wires 74 and 76, and the entire shield structure is grounded by a wire 78 connected to the wire 76.

In an electronic article surveillance system, both the transmitting and receiving antennas should be magnetic antennas, and should not emit or be responsive to electric fields in order to prevent radiating electrical fields that could interfere with other electronic equipment and to prevent the system from being falsely triggered by spurious signals. In addition, the magnetic field response of both the transmitting and receiving antennas should be balanced, i.e., the magnetic field response of each of the four loop sections of each antenna should be approximately the same so that the magnetic field radiated by the loop sections of the transmitting antenna will cancel at distances removed from the immediate vicinity of the antenna to prevent interference with other electronic equipment. Similarly, the responses of the loop sections of the receiving antenna should be balanced to make the antenna nonresponsive to distant radiated magnetic field signals.

In the past, shielding of the antenna for the purpose of reducing the electric field consisting of surrounding substantially the entire antenna with grounded shields in the forms of coaxial cable or conductive pipe or tubing to reduce the electric field response. However, magnetic field coupling between the twisted loops and the shields of the prior art resulted in an unbalanced magnetic field pattern. Thus, in accordance with an important aspect of the invention, certain portions of the shield portion of the electric field shielding system are magnetically decoupled from the twisted loops. This is accomplished by the wires 40 and 42 of the transmitting antenna 12 and the wires 74 and 76 of the receiving antenna 14. The aforementioned wires provide electrical continuity about the periphery of the antennas 12 and 14 to provide better magnetic balance while still permitting the electric field shields to be grounded and to act as a Faraday shield. However, by strategically positioning the wires 40, 42, 74 and 76 with respect to the various loop sections, and by connecting the wires to appropriate points along the shield structure, certain portions of the shield structure can be magnetically decoupled from the twisted loops without affecting the electric field performance.

For example, if the lower-most horizontal sections 36 and 38 of the transmitting antenna 12 were connected together either physically or by means of a wire connected across the gap between the sections 36 and 38, and the sections 36 and 38 grounded, an effective electric field shield would be obtained. However, the magnetic coupling between the shield and the loop section 26 would be fixed by the spacing between the loop section 26 and the horizontal sections 36 and 38 and could not be adjusted for the purposes of magnetic field balance. However, magnetic field balance can be achieved independently of the electric field shielding process by appropriately positioning the wire 42. By connecting the wire 42 between the horizontal portions 28 and 30 of the shield structure, all magnetically induced currents flowing through the shield structure flow through the wire 42 and not through the horizontal sections 36 and 38. Since the horizontal sections 36 and 38 do not form part of a closed circuit, there is no current induced into them by the loop section 26. Any current induced by the loop section 26 flows through the wire 42 instead, and by adjusting the spacing between the loop section 26 and the wire 42, the amount of current induced by the loop section 26 into the wire 42 can be controlled. Thus, by adjusting the spacing between the loop section 26 and the wire 42, the magnetic response of the antenna can be adjusted until balance is achieved. A similar balance can be achieved in the receiving antenna by connecting the wires 74 between the vertical sections 62 and 64 of the shield and by appropriately spacing the wire 74 from the loop section 54.

It has also been found that it is not necessary to shield substantially the entire portions of the twisted loops. For example, by connecting the wire 40 between the vertical sections 28 and 30 of the transmitting antenna 12, no shielding is required about the upper portion of the loop section 18. Proper positioning of the wire 40 adjacent the upper portion of the loop section 18 provides electric field shielding as well as a control of the magnetic field response balance which is obtained by adjusting the spacing between the wire 40 and the upper portion of the loop section 18. Similarly, the wire 76 connected between the vertical portions 62 and 64 of the receiving antenna 14 provides electric field shielding and magnetic field balance. The currents that are induced in the shield by the twisted loops, when balanced, stabilize the magnetic field of the antenna, and the spacing between the wires 40 and 76 and the loop sections 18 and 60 affects the magnitude of the currents induced in the shield. These currents affect the magnetic balance of the antenna, and for optimum balance for the antenna configuration shown, a spacing of on the order of at least one inch and preferably two inches has been determined to be necessary to magnetically decouple a portion of the shield in an antenna operating at a frequency of on the order of 8 mHz.

The transmitting antenna 12 is driven by a swept frequency signal transmitter 100 that applies the swept frequency signal to one of the twisted loops directly and to the other one of the twisted loops through a network 102 consisting of a transformer 104 having a primary winding 106 and a secondary winding 108. The network 102 also includes a phase shifting network including a pair of resistors 110 and 112 and a pair of capacitors 114 and 116.

Signals received from the receiving antenna 14 are applied to a receiver 120. As in the case of the transmitter 100, the receiver 120 is coupled directly to one of the twisted loops and to the other of the twisted loops via a network 122. The network 122 comprises a transformer 124 having a primary winding 126 and a secondary winding 128 and a pair of resistors 130 and 132 and a pair of capacitors 134 and 136 connected to the winding 126.

The function of the networks 102 and 122 is to adjust the phase relationship between the two twisted loops of each respective antenna. In addition, the relative drive or sensitivity of each of the twisted loops in each antenna is adjusted by the networks 102 and 122.

When the system is in operation, a swept frequency signal that is swept over a predetermined range is applied to the antenna 12 from the transmitter 100. The articles being protected are fitted with a tag such as a tag 140 that contains a resonant circuit that has a resonant frequency within the range of frequencies of the transmitter 100. A tag suitable for such applications is disclosed in U.S. Pat. Nos. 4,818,312 and 4,846,922. When such a tag is passed between the antennas 12 and 14, as shown in the drawing, the tag 140 causes a perturbation in the field between the antennas 12 and 14 which generates a detectable tag signal whenever the frequency of the transmitter 100 passes through the resonant frequency of the tag 140. This perturbation or tag signal is sensed by the receiver 120 which causes an alarm 142 to be sounded.

The amount of perturbation of the field that generates the tag signal generated by the tag 140 that is detected by the receiver 120 is dependent upon the location of the tag between the antennas 12 and 14 and its orientation with respect to the antennas. Consequently, it has been found advantageous to drive the two twisted loops of the antenna 12 in quadrature so that the magnetic field radiated by each of the four loop sections comprising the antenna 12 would be in quadrature with each adjacent loop section. The combined fields radiated by adjacent loop sections results in a rotating field that whose field lines intercept the tag 140 regardless of its orientation, thus improving detection capability. Consequently, the values of the resistors 110 and 112 and of the capacitors 114 and 116 are adjusted so that the two twisted loops of the antenna 12 are driven in quadrature. Similarly, the value of the resistors 130 and 132 and of the capacitors 134 and 136 of the network 122 are adjusted so that the outputs of the two twisted loops of the antenna 14 are combined in quadrature before being applied to the receiver 120. This renders the detectability of the tag 140 by the receiver 120 less susceptible to the orientation of the tag 140.

The signal generated by the tag 140 when the frequency of the transmitter 100 passes through the resonant frequency of the tag 140 has a distinct shape that is detected and analyzed by the receiver 120 prior to sounding the alarm 142. However, the amplitude of the distinct signal produced by the tag is very small and is often considerably smaller than other signals received by the receiver 120 including the signal received from the transmitting antenna 12. The signal received from the transmitting antenna 12 is generally the largest signal received by the antenna 14, and contains the swept frequency generated by the transmitter 100 as well as any noise generated by the transmitter 100. Although the signal-to-noise ratio of modern transmitters is quite good, because of the extremely large amplitude of the signal from the transmitter 100 relative to the amplitude of the signal generated by the tag 140, even with good signal-to-noise ratios, the amplitude of the noise generated by the transmitter 100 can be significant when compared with the amplitude of the low amplitude signal from the tag 140. Consequently, in accordance with another important aspect of the present invention, it is desirable to make the receiving antenna 14 less responsive to signals received from the transmitting antenna 12 without significantly affecting its response to signals from the tag 140.

It has been found that the coupling between the antennas 12 and 14, and hence the amount of signal received from the antenna 12 by the antenna 14, can be reduced without significantly reducing the amount of signal received from the tag 140, for example, by adjusting the turns ratio of the transformers 104 and 124 to alter the relative drive applied to the twisted loops 16 and 22 of the antenna 12 and the relative sensitivity of the twisted loops 50 and 52 of the antenna 14. For example, if the transformer 104 is a step-up transformer, the loop driven through the transformer 104 will have a higher drive than the loop driven directly by the transmitter 100. Thus, if the turns ratio of the transformer 104 is selected such that the transformer 104 has a step-up ratio of 2:1 (the secondary winding 108 having twice as many turns as the primary winding 106), the twisted loop 16 will receive a greater amount of drive than the twisted loop 22 that is directly driven by the transmitter 108. The transformer ratio is referred to as a stagger ratio, and in the above-discussed example, the stagger ratio would be two.

In order to compensate for the increased drive applied to the twisted loop of the antenna 12, the sensitivity of the twisted loop 50 of the antenna 14, which lies opposite the loop 16 of the antenna 12 is correspondingly reduced. This is accomplished by selecting the turns ratio of the transformer 124 such that the transformer 124 acts as a step-down transformer so that less of the signal from the twisted loop 50 is applied to the receiver 120. Preferably, the step-down ratio of the transformer 124 should be equal to the step-up ratio of the transformer 104, i.e., 2:1 (the primary 126 having twice as many turns as the secondary 128), thus also giving a stagger ratio of two.

It has been found that in addition to staggering the drive and sensitivity of the respective transmitting and receiving antennas 12 and 14, a further improvement in performance can be obtained by adjusting the Q or quality factor of the loops driven through the networks 102 and 122. It has been found that performance may be optimized by adjusting the Q of the twisted loops 16 and 50 connected to the respective networks 102 and 122 so that the Q is equal to the reciprocal of the stagger ratio. For example, assuming a stagger ratio of 2 the optimal Q for the antennas driven through the phase shifting networks would 0.5. This would be obtained by adjusting the values of the resistors 110, 112, 130 and 132 and the capacitors 114, 116, 132 and 136 until the optimum Q is obtained. Similarly, for a stagger ratio of 3 a Q of 0.33 would be optimal. Preferably, the stagger ratio should on the order of 2 to 3.

Obviously, many modifications and variations of the present invention are possible in light of the above teachings. Thus, it is to be understood that, within the scope of the appended claims, the invention may be practiced than as specifically described above.

What is claimed and desired to be secured by Letters Patent of the United States is:

1. A magnetic antenna for use in an electronic article surveillance system, comprising:

a twisted loop having two loop sections fabricated from an elongated conductor, said loop sections being twisted 180° with respect to each other and lying in a substantially common plane;

means for providing an electric field shield around said twisted loop including a conductive elongated shield surrounding a portion of the conductor of said twisted loop, said shield having an open circuit along the length thereof; and means for balancing the magnetic response of said antenna including a balancing conductor connected across the open circuit to predetermined portions of the shield at opposite sides of the open circuit to thereby electrically bypass portions of the shield.

2. A magnetic antenna as recited in claim 1 wherein said balancing conductor is magnetically coupled to said conductor forming said twisted loop.

3. A magnetic antenna, comprising:

a first twisted loop having a first and second spaced apart loop sections lying in a substantially common plane and twisted substantially 180° with respect to each other;

a second twisted loop having third and fourth spaced apart loop sections twisted substantially 180° with respect to each other, said third and fourth loop sections lying in substantially the same plane as said first and second loop sections, said second loop section being interposed between said third ad fourth loop sections and said third loop section being interposed between said first and second loop sections along said common plane;

means for electrically coupling together said first and second twisted loops; and means including a tubular conductive structure having a gap therein for providing an electric field shield for said first and second twisted loops, said conductive tubular structure surrounding portions of said first, second, third and fourth loop sections and being magnetically coupled thereto, and conductive means connected across said gap to a portion of the tubular structure that surrounds a portion of one of said first and fourth loop sections for magnetically decoupling said portion of the tubular structure that surrounds one of said first and fourth loop sections from the respective loop section.

4. A magnetic antenna as recited in claim 3 wherein said coupling means includes means for providing substantially 90° phase shift between said first and second loops.

5. A magnetic antenna as recited in claim 3 wherein said coupling means includes means for coupling said first and second twisted loops to a utilization device, one of said first and second twisted loops being more closely coupled to said utilization device than the other.

6. A magnetic antenna as recited in claim 3 wherein said decoupling means includes a conductor connected tot he tubular structure bridging the portion of the tubular structure to be decoupled.

7. A magnetic antenna as recited in claim 6 wherein the portion of the tubular structure to be decoupled has an open circuit therein.

8. An antenna for use near an exit of an area protected by an electronic article surveillance system, said antenna having first and second twisted loops, each of said twisted loops being twisted only once and cooperating to form first, second, third and fourth loop sections disposed in a vertical, substantially coplanar array of single loop sections, said first loop section being disposed at the top of the array, said fourth loop section being disposed at the bottom of the array, said second loop section being disposed immediately below said first loop section and said third loop section being interposed between said second and fourth loop sections, said first twisted loop being twisted 180° to form said first and third loop sections, said second twisted loop being twisted to form said second and fourth loop sections, means including a conductive tubular structure for providing an electric field shield for said first and second twisted loops, said conductive tubular structure surrounding portions of said first, second, third and fourth loop sections, said tubular conductive structure being magnetically coupled to said first, second, third and fourth loop sections, and conductive means connected to the tubular structure that surrounds one of said first and fourth loop sections for magnetically decoupling a portion of the tubular structure surrounding one of said first and fourth loop sections from the respective loop section.

9. An antenna for use near an exit of an area protected by an electronic article surveillance system, said antenna having first and second twisted loops, each of said twisted loops being twisted only once and cooperating to form first, second, third and fourth loop sections disposed in a vertical, substantially coplanar array of single loop sections, said first loop section being disposed at the top of the array, said fourth loop section being disposed at the bottom of the array, said second loop section being disposed immediately below said first loop section and said third loop section being interposed between said second and fourth loop sections, said first twisted loop being twisted 180° to form said first and third loop sections, said second twisted loop being twisted to form said second and fourth loop sections, means including a conductive tubular structure for providing an electric field shield for said first and second twisted loops, said conductive tubular structure surrounding portions of said first, second, third and fourth loop sections, said tubular structure being magnetically coupled to said first, second, third and fourth loop sections, and conductive means connected to the tubular structure that surrounds one of said first and fourth loop sections for magnetically decoupling a portion of the tubular structure surrounding one of said first and fourth loop sections from the respective loop section, wherein said tubular structure surrounding said one of said first and fourth loop sections has a gap therein, and wherein said conductive means includes a conductor bridging said gap.

10. An antenna system as recited in claim 9 wherein said conductor is a wire.

11. An antenna system for use in an electronic article surveillance system having a transmitter and a receiver, said antenna system comprising:

a transmitting antenna having first and second transmitting loops lying in a substantially common plane and means for electrically coupling said first and second transmitting loops to said transmitter, said electric coupling means including means for more closely electrically coupling said first transmitting loop to said transmitter than is said second transmitting loop; and a receiving antenna having first and second receiving loops lying in a substantially common plane and means for electrically coupling said first and second receiving loops to said receiver, said receiving antenna being disposed adjacent said transmitting antenna in a parallel relationship therewith and defining a passageway therebetween, with the first loop of the receiving antenna being disposed adjacent the first loop of the transmitting antenna and the second loop of the receiving antenna being disposed adjacent the second loop of the transmitting antenna, said receiving antenna electrical coupling means including means for more closely coupling said second receiving loop to said receiver than is said first receiving loop.

12. An antenna system for use in an electronic article surveillance system having a transmitter and a receiver, said antenna system comprising:

a transmitting antenna having first and second transmitting loops lying in a substantially common plane and means for electrically coupling said first and second transmitting loops to said transmitter, said electric coupling means including means for more closely electrically coupling said first transmitting loop to said transmitter than is said second transmitting loop; and a receiving antenna having first and second receiving loops lying in a substantially common plane and means for electrically coupling said first and second receiving loops to said receiver, said receiving antenna being disposed adjacent said transmitting antenna in a parallel relationship therewith and defining a passageway therebetween, with the first loop of the receiving antenna being disposed adjacent the first loop of the transmitting antenna and the second loop of the receiving antenna being disposed adjacent he second loop of the transmitting antenna, said receiving antenna electrical coupling means including means for more closely coupling said second receiving loop to said receiver than is said first receiving loop, wherein the coupling means of each antenna includes a transformer having a predetermined turns ratio.

13. An antenna system as recited in claim 12 wherein the turns ratio of each of said transformers is on the order of approximately 2 to 3:1.

14. An antenna system as recited in claim 12 wherein the coupling means of each antenna includes means including a phase shift network for shifting the relative phases of said first and second loops.

15. An antenna system as recited in claim 14 wherein said transformer has first and second windings and said phase shift network is connected to one of said loops and said first winding, said first and second windings having a turns ratio of N:1, and wherein said phase shift network and said loop connected thereto form a circuit having a predetermined Q equal to the reciprocal of the turns ratio.

16. An antenna system as recited in claim 15 wherein one of said transformers is a step-up transformer and the other is a step-down transformer.

17. An antenna system as recited in claim 15 wherein N is equal to approximately 2 to 3.

18. An antenna system as recited in claim 15 wherein each of said transmitting loops is a twisted loop having first and second spaced loop sections, the first and second loop sections of said first transmitting loop being interleaved with the first and second loop sections of said second transmitting loop, and wherein each of said receiving loops is a twisted loop having first and second loop sections, the first and second loop sections of said first receiving loop being interleaved with the first and second loop sections of said second receiving loop.

19. An antenna system as recited in claim 18 wherein said phase shift means is operative to shift the relative phases of said first and second loops by approximately 90°.

20. An antenna system as recited in claim 19 wherein said transformer has first and second windings and said phase shift network is connected one of said loops and to said first windings, said first and second windings have a turns ratio of N:1, and wherein said phase shift network and said loop connected thereto form a circuit having a predetermined Q equal to the reciprocal of the turns ratio.

21. An antenna system as recited in claim 20 wherein N is equal to approximately 2 to 3.

22. An antenna system for electronic article surveillance system having a transmitter and a receiver, comprising:

a transmitting antenna having two loops disposed in a substantially common plane and means for transmitting signals from said transmitter with greater intensity from one of said loops than from the other; and a receiving antenna having two loops disposed in a substantially common plane and means for receiving signals with greater sensitivity from one of said receiving loops than the other, said receiving antenna being disposed adjacent to said transmitting antenna in a substantially parallel relationship therewith and defining a passageway therebetween, the loops of the transmitting and receiving antennas being oriented such that the greater sensitivity loop of said receiving antenna is disposed opposite the lesser intensity loop of the transmitting antenna and vice versa.

* * * * *

UNITED STATES PATENT AND TRADEMARK OFFICE

CERTIFICATE OF CORRECTION

PATENT NO. : 4,999,641

DATED : March 12, 1991

INVENTOR(S) : ROBERT A. CORDERY et al.

It is certified that error appears in the above-identified patent and that said Letters Patent is hereby corrected as shown below:

Column 1, line 36, delete "the" (second occurrence);
line 37, delete "application";
line 45, delete "the" (second occurrence);
lines 45 and 46, delete "application".
Column 3, line 1, delete "the";
line 1, delete "application";
line 54, delete "consisting" and substitute --consisted--.
Column 5, line 47, delete "that".
Column 7, line 29, delete "a" (second occurrence);
line 67, delete "tot he" and substitute --to the--.

Column 9, line 42, delete "he" and substitute --the--.
Column 10, line 28, after "connected" insert --to--.

Signed and Sealed this

Second Day of February, 1993

*Attest:*

STEPHEN G. KUNIN

*Attesting Officer*

*Acting Commissioner of Patents and Trademarks*